US008844309B2

(12) United States Patent
Grosse et al.

(10) Patent No.: US 8,844,309 B2
(45) Date of Patent: Sep. 30, 2014

(54) FAST ICE MAKING DEVICE

(75) Inventors: Alexandre D. Grosse, Iowa City, IA (US); Adriana S. Guillen, San Nicolas de los Garza (MX)

(73) Assignee: Whirlpool Corporation, Benton Harbor, MI (US)

( * ) Notice: Subject to any disclaimer, the term of this patent is extended or adjusted under 35 U.S.C. 154(b) by 1058 days.

(21) Appl. No.: 12/723,772

(22) Filed: Mar. 15, 2010

(65) Prior Publication Data

US 2011/0219789 A1 Sep. 15, 2011

(51) Int. Cl.

| | |
|---|---|
| ***F25C 1/22*** | (2006.01) |
| ***F25C 5/18*** | (2006.01) |
| ***F25C 5/08*** | (2006.01) |
| ***F25C 5/10*** | (2006.01) |
| ***F25C 1/00*** | (2006.01) |
| ***F25C 1/16*** | (2006.01) |

(52) U.S. Cl.

CPC ..... *F25C 1/16* (2013.01); *F25C 2400/10* (2013.01); *F25C 2600/04* (2013.01); *F25C 2700/02* (2013.01)

USPC ..... 62/340; 62/344; 62/349; 62/352; 62/353

(58) Field of Classification Search

USPC ..... 62/340, 344, 349, 352, 353

See application file for complete search history.

(56) References Cited

U.S. PATENT DOCUMENTS

| | | | |
|---|---|---|---|
| 3,443,393 | A | 5/1969 | Goldberg |
| 3,690,116 | A | 9/1972 | Cheng et al. |
| 3,859,069 | A | 1/1975 | Seliber |
| 5,207,073 | A | 5/1993 | Maier-Laxhuber et al. |
| 6,038,869 | A | 3/2000 | Lee et al. |
| 6,354,102 | B1 | 3/2002 | Hozumi et al. |
| 6,920,764 | B2 | 7/2005 | Zevlakis |
| 6,935,124 | B2 | 8/2005 | Takahashi et al. |
| 7,013,669 | B2 | 3/2006 | Ophir et al. |
| 2006/0218961 | A1 | 10/2006 | Kim et al. |

FOREIGN PATENT DOCUMENTS

| | | | |
|---|---|---|---|
| JP | 4131674 | A | 5/1992 |

*Primary Examiner* — Ljiljana Ciric

(57) ABSTRACT

A refrigerator includes a fast ice making device for quickly producing ice cubes. The fast ice making device includes a mold body having a plurality of ice forming cavities adapted to hold fluid. In an ice making cycle, a vacuum system evacuates air from the cavities, thereby depressurizing the cavities. Then, a liquid delivery system delivers liquid to the depressurized cavities, whereby an initial portion of the liquid bubbles up within the respective cavities. Overall, a cooler fluid is established at the beginning of an ice making cycle, thus accelerating the rate at which ice cubes are formed within the fast ice making device. Once ice cubes have been formed within the cavities, a heat transfer system is utilized to heat the cavities, thereby slightly melting the ice cubes and aiding in the expulsion of ice cubes from the cavities.

8 Claims, 3 Drawing Sheets

FAST ICE MAKING DEVICE

BACKGROUND OF THE INVENTION

1. Field of the Invention

The present invention pertains to the art of refrigerators and, more particularly, to a fast ice making device within a refrigerator.

2. Description of the Related Art

Whether to ensure an adequate amount of ice for a party or just to keep up with daily demand, there is a need to decrease ice production time. To address this concern in the art of refrigerated appliances, it is known to employ fans or other similar devices to direct air across an ice mold in order to decrease ice production time. Typically, the fan is oriented to direct a flow of air from an evaporator over the ice mold. The flow of air disturbs a thermal barrier that is present about the ice mold in order to increase temperature transfer rates and, as a consequence, decrease an amount of time required to form ice.

While the above described arrangements simply utilize fans, other arrangements expose the ice mold directly to the evaporator and utilize an evaporator fan to blow cool air. In some cases, the evaporator is part of a primary refrigeration system that is employed to maintain temperatures in fresh food and freezer compartments of the refrigerator, while in other cases the evaporator is dedicated to ice production. Dedicated evaporators are typically employed in systems which locate the icemaker in a portion of the refrigerator other than the freezer compartment. While effective, the above described systems typically rely on a cooling demand signal to operate. That is, regardless of a need for ice, the above described systems only function when either the fresh food or freezer compartment requires cooling which necessitates the activation of the refrigeration system. Correspondingly, even during periods when no ice production is required, the above described systems function upon activation of the refrigeration system.

Although the above-described methods reduce ice production time, there still exists the need for ice making systems which can further reduce ice production time within a refrigerator and does not rely on activation of a fan system.

SUMMARY OF THE INVENTION

The present invention is directed to a refrigerator including a fast ice making device. The fast ice making device includes an ice mold body having a plurality of ice forming cavities formed therein. Each of the plurality of ice forming cavities is in communication with a liquid delivery system via one or more liquid lines and liquid inlets. Additionally, a vacuum system includes a vacuum pump which is in communication with each of the plurality of ice forming cavities via one or more pressure lines and pressure inlets.

In use, a controller activates the vacuum system at the beginning of an ice making cycle and air is evacuated from the ice forming cavities, creating reduced or depressurized cavities. A water delivery system then supplies fluid to each of the depressurized ice forming cavities. In accordance with the present invention, due to the vacuum environment, the initial fluid entering the depressurized cavities is caused to boil, i.e., bubble up as trapped air in the fluid rises to the surface, with this boiling establishing a cooler fluid at the beginning of the ice making cycle, thus accelerating the rate at which ice cubes are formed within the fast ice making device. Once ice cubes are formed, a heat transfer system is used to slightly melt the ice cubes to aid in ejection of the ice cubes from the ice mold body.

Additional objects, features and advantages of the present invention will become more readily apparent from the following detailed description of the preferred embodiments when taken in conjunction with the drawings wherein like reference numerals refer to corresponding parts in the several views.

DETAILED DESCRIPTION OF PREFERRED EMBODIMENTS

Figure 1:
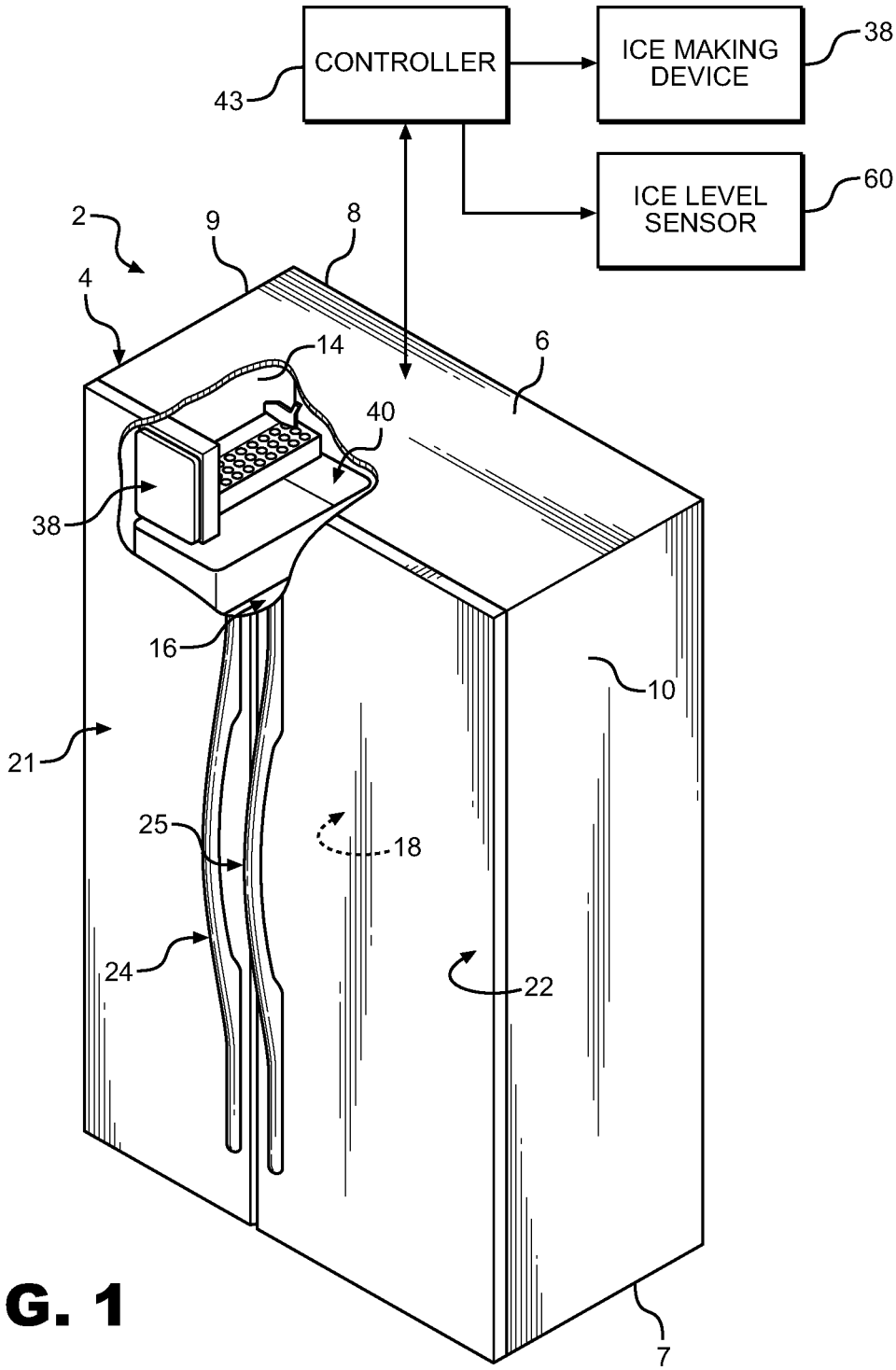
FIG. 1 is an upper left perspective view of a refrigerator incorporating a fast ice making device constructed in accordance with the present invention.

As best shown in FIG. 1, a refrigerator constructed in accordance with the present invention is generally indicated as 2. Refrigerator 2 includes a cabinet 4 having a top wall 6, a bottom wall 7, a rear wall 8, and opposing sidewalls 9 and 10 that collectively define a refrigerator body. Refrigerator 2 is further shown to include a liner 14 that defines a freezer compartment 16. A fresh food compartment 18 is arranged alongside freezer compartment 16 such that refrigerator 2 defines a side-by-side model. Of course, it should be understood that the present invention can be readily incorporated into various refrigerator models, including top mount, bottom mount and French-style door model refrigerators. At this point, it should also be understood that the referenced freezer compartment 16 could be constituted by a dedicated ice producing section provided in the fresh food compartment. In any case, in the exemplary embodiment shown, refrigerator 2 includes a freezer compartment door 21 and a fresh food compartment door 22 pivotally mounted to cabinet 4 for selectively providing access to freezer compartment 16 and fresh food compartment 18 respectively. In a manner also known in the art, each compartment door 21, 22 includes a corresponding handle 24, 25.

In accordance with the invention, refrigerator 2 is provided with a fast ice making device 38 for dispensing ice into an ice cube storage bin 40. As will be discussed more fully below, fast ice making device 38 produces ice cubes in less time than conventional icemakers. Toward that end, various functions of fast ice making device 38 are controlled a controller 43. In accordance with the present invention, controller 43 can be incorporated into fast ice making device 38, or may be a separate part of refrigerator 2.

Figure 2:
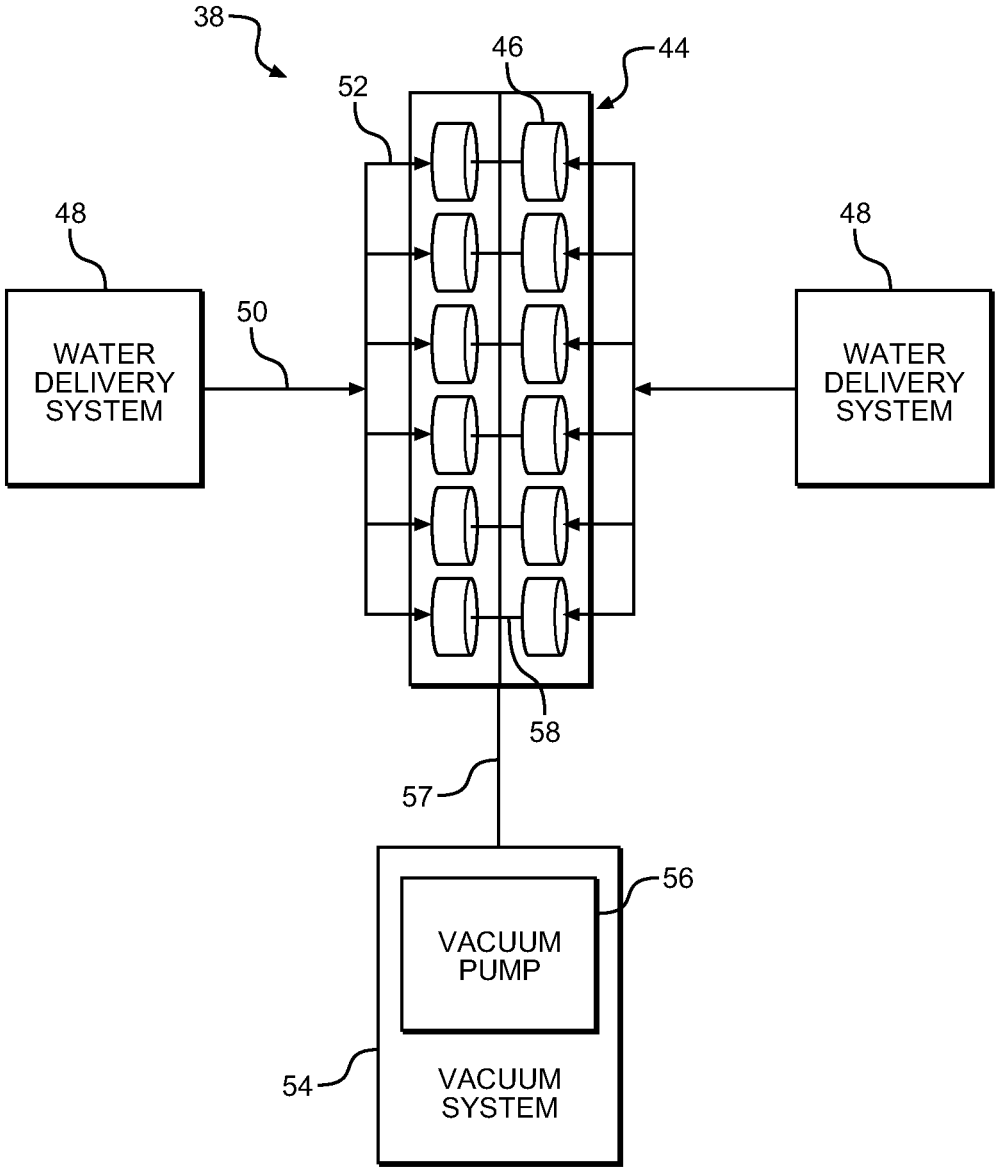
FIG. 2 is a schematic side view of the ice making device of FIG. 1.
Figure 3:
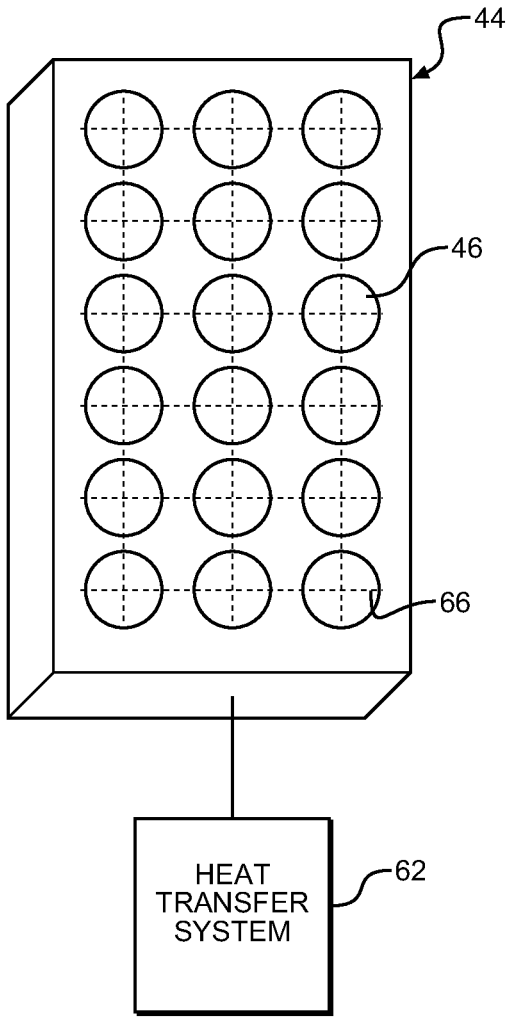
FIG. 3 is a schematic front view of the ice making device of FIG. 1.

As best seen in FIGS. 2 and 3, fast ice making device 38 includes a mold body 44, shown with two sealably mating, symmetrically constructed mold body portions, establishing a plurality of ice forming cavities 46. In the preferred embodiment shown, each ice forming cavity 46 has a generally cylindrical shape for producing correspondingly shaped ice cubes. However, it should be understood that ice forming cavities 46 can take on any shape to produce a desired ice cube appearance. Each of the plurality of ice forming cavities 46 is in communication with a liquid delivery system 48 via one or more liquid lines 50 and liquid inlets 52. Additionally, each of the plurality of ice forming cavities 46 is in communication with a vacuum system 54. More specifically, in accordance with the present invention, a vacuum pump 56 is in communication with each of the plurality of ice forming cavities 46 via one or more pressure lines 57 and pressure ports 58.

In use, when the need for ice cubes is detected, controller 43 activates vacuum pump 56 of vacuum system 54 which evacuates air from ice forming cavities 46, creating depressurized, i.e., reduced pressure or vacuum, cavities. It should be understood that the need for ice cubes can be determined using any conventional technology, such as a bale arm or other known ice level sensor system as generically represented by ice level sensor 60 depicted in FIG. 1. Next, water delivery system 48 is activated and fluid is supplied to each of the depressurized ice forming cavities 46. In accordance with the present invention, the initial supply of fluid entering depressurized cavities 46 is caused to boil, i.e., bubble up so that air bubbles in the fluid rises to the surface. With a reduced gas content due to lack of entrapped air, the fluid has an increased heat transfer potential at the beginning of an ice making cycle, thus accelerating the rate at which ice cubes are formed within fast ice making device 38.

The formation of ice cubes within cavities 46 may be determined in a manner known in the art, such as by positioning one or more sensors (not shown) directly in fast ice making device 38 or after a predetermined period of time has passed. Once it is determined that ice cubes have been formed, the ice cubes are ejected from mold body 44 in a manner known in the art, such as by utilizing an ejector (not shown) or inverting ice mold body 44. With specific reference to FIG. 3, once ice cubes are fully formed within ice mold body 44, a heat transfer system 62 is preferably utilized to warm ice forming cavities 46 in order to slightly melt ice cubes formed therein to aid in dispensing of the ice cubes from mold body 44. In the preferred embodiment shown, heat transfer device 44 utilizes wires 66 formed within ice mold body 44 to deliver targeted heat to each of the ice forming cavities 46. However, it should be understood that various known heat transfer system 62 could be utilized with the fast ice making device 44 of the present invention.

Although described with reference to preferred embodiments of the invention, it should be readily understood that various changes and/or modifications can be made to the invention without departing from the spirit thereof. For instance, the illustrated and described structure of ice mold body 44 is provided to aid in understanding of the present invention. However, it should be understood that ice mold body 44 could include a different configuration and, with the addition of the features of the invention, the fast ice making arrangement could be incorporated in various known icemaker systems. In general, the invention is only intended to be limited by the scope of the following claims.

What is claimed is:

1. A refrigerator comprising:

a cabinet;

a refrigerated compartment arranged within the cabinet;

a door mounted to the cabinet for selectively providing access to the a refrigerated compartment; and a fast ice making device provided in the refrigerated compartment, the fast ice making device including:

a mold body including at least one ice forming cavity configured to contain water therein;

a liquid delivery system in communication with the at least one ice forming cavity and configured to deliver liquid to the ice forming cavity; and a vacuum system including a vacuum pump in communication with the at least one ice forming cavity and adapted to create a vacuum within the ice forming cavity wherein, when liquid is delivered to the at least one ice forming cavity, an initial portion of the liquid boils prior to forming ice cubes in the mold body.

2. The refrigerator of claim 1, wherein the fast ice making device further comprises: a heat transfer device for selectively applying heat to the at least one ice forming cavity.

3. The refrigerator of claim 1, further comprising: a controller, in communication with both the liquid delivery system and the vacuum system, for selectively activating the liquid delivery system and the vacuum system.

4. The refrigerator of claim 1, wherein the at least one ice forming cavity has a generally cylindrical shape.

5. A fast ice making device comprising:

a mold body including at least one ice forming cavity configured to contain water therein;

a liquid delivery system in communication with the at least one ice forming cavity and configured to deliver liquid to the ice forming cavity; and a vacuum system including a vacuum pump in communication with the at least one ice forming cavity and adapted to create a vacuum within the cavity wherein, when liquid is delivered to the at least one cavity, an initial portion of the liquid boils prior to forming ice cubes in the mold body.

6. The fast ice making device of claim 5, further comprising: a heat transfer device for selectively applying heat to the at least one ice forming cavity.

7. The fast ice making device of claim 5, further comprising: a controller, in communication with both the liquid delivery system and the vacuum system, for selectively activating the liquid delivery system and the vacuum system.

8. The fast ice making device of claim 5, wherein the at least one ice forming cavity has a generally cylindrical shape.

* * * * *